US005366228A

United States Patent [19]

Kangsanaraks

[11] Patent Number: 5,366,228

[45] Date of Patent: Nov. 22, 1994

[54] CARD GAME

[76] Inventor: Adisorn Kangsanaraks, 2658 Karen Ct. #621, Las Vegas, Nev. 89109

[21] Appl. No.: 267,229

[22] Filed: Jul. 5, 1994

[51] Int. Cl.[5] ..... A63F 1/00

[52] U.S. Cl. ..... 273/292

[58] Field of Search ..... 273/274, 292, 303

[56] References Cited

U.S. PATENT DOCUMENTS

| | | | |
|---|---|---|---|
| 4,659,087 | 4/1987 | Shen et al. . | |
| 5,013,049 | 5/1991 | Tomaszewski . | |
| 5,098,107 | 3/1992 | Boylan et al. . | |
| 5,154,429 | 10/1992 | LeVasseur . | |
| 5,224,706 | 7/1993 | Bridgeman et al. | 273/292 X |
| 5,288,077 | 2/1994 | Jones | 273/292 |
| 5,288,081 | 2/1994 | Breeding . | |
| 5,288,082 | 2/1994 | Marquez | 273/292 |
| 5,314,193 | 5/1994 | Ferrer . | |
| 5,320,356 | 6/1994 | Cauda | 273/292 |
| 5,322,295 | 6/1994 | Cabot et al. | 273/292 |
| 5,328,189 | 7/1994 | Malek | 273/292 |

FOREIGN PATENT DOCUMENTS

| | | | |
|---|---|---|---|
| 9216269 | 10/1992 | WIPO | 273/292 |

*Primary Examiner*—William E. Stoll

*Attorney, Agent, or Firm*—Richard C. Litman

[57] ABSTRACT

A card game provides for the simultaneous wagering on both occurrence of a numerically superior hand, as well as the occurrence of a flush or three of a kind during the play of the hand. At least one standard deck of cards is used, with the ace through nine of each suit respectively being valued at one through nine points, and the ten through king of each it having no value. The object of the game is to arrive at a total point count of nine in the hand of two or three cards, with the player or dealer coming closest to nine, winning the hand; the tens digit is dropped if the card values exceed ten. Two cards are initially dealt to the players and dealer, with the dealer's first card being dealt face up. The dealer is limited to inflexible rules governing the drawing of a third card, but the players may draw a third card freely as desired. Wagers may be placed upon the occurrence of a two or three card flush, or three of a kind assuming a player(s) draw(s) a third card, in addition to wagering on the outcome of a numerically superior hand i.e., closest to nine. The occurrence of a flush or three of a kind in the dealer's hand effects the payoff of flush or three of a kind hands for the player(s), with the player(s) being required to have exactly nine points under such conditions.

9 Claims, 4 Drawing Sheets

CARD GAME

FIELD OF THE INVENTION

The present invention relates generally to card games, and more specifically to a wagering game in which players attempt to reach a count of nine and simultaneously wager on the occurrence of cards of the same suit or rank being dealt.

BACKGROUND OF THE INVENTION

Various wagering card games have been developed in the past, such as blackjack (or twenty one), baccarat, seven and a half, etc., in which the object is to reach a given maximum count, depending upon the values assigned to the cards according to the game rules. In many cases, exceeding maximum allowable predetermined count results in a "bust," in which the player is automatically eliminated from that hand with no further chance to win. Players are in many instances discouraged by such occurrences, and games in which players cannot "bust" may provide greater enjoyment for players, as they may continue to play the hand through the final card of the hand.

All of the above types of wagering games, in which the player attempts to most closely approach a predetermined value or count with his/her cards, rely strictly upon the numerical value of the cards to determine the winning and losing hands. While generally the game rules are relatively simple, the games are nevertheless extremely fast paced at the casino level, in order to increase the income of the casino. Thus, it can be difficult for a novice player to keep up with the pace of the game and calculate the numerical differences and totals involved.

Accordingly, the need arises for a card game which may include the step of placing wagers or bets on the outcome of the hands, which game involves attempting to reach a predetermined count or value with the cards of each hand, depending upon the numerical values assigned to those cards according to the rules of the game. The game should not include rules in which players or the dealer "bust" by exceeding the predetermined total, and moreover should include additional means of wagering on the outcome of the hands other than strictly considering the relative numerical values of the card hands. The game should also provide for wagering on the occurrence of flush hands, in which all of the cards of a given hand are of the same suit, in order to allow the novice player a means of easily determining a winning hand in addition to the numerical value, and moreover a means of allowing an experienced player to place further wagers on the outcome of a hand, over and above the numerical values.

DESCRIPTION OF THE PRIOR ART

U.S. Pat. No. 4,659,087 issued to Margaret Shen et al. on Apr. 21, 1987 discloses a Casino Game in which each player and the dealer is dealt two hands. Comparisons are made between the numerical values of the players' and dealer's hands, with the object being for the players' two hands to exceed the value of the dealer's two hands. The game is thus relatively complex, in that each player must arrange his/her cards into two hands with the point count as desired, and then compare each hand against each dealer hand. No disclosure is made of wagering or payoffs for flush hands, as provided by the present card game invention.

U.S. Pat. No. 5,013,049 issued to Joseph Tomaszewski on May 7, 1991 discloses a Card Game in which the object is to reach a total of 21 with the card hand. Exceeding that total is a "bust," in which the player automatically loses and may no longer play the hand. Cards may be discarded and further cards drawn, which is not permitted according to the present game rules. The resulting discarding and drawing results in each hand having a fixed number of cards at all times, unlike the present game. Ties may be broken using several methods, one of which includes a flush hand. However, the flush provides no payoff in and of itself, but rather is only used to break a numerical tie, unlike the present game.

U. S. Pat. No. 5,098,107 issued to Eugene B. Boylan et al. on Mar. 24, 1992 discloses a Method And Apparatus For Playing A Wagering Game in which additional cards or symbols are added to a conventional card deck. Wagers are made on the occurrence of various combinations of cards, including straights, flushes, and pairs, as well as the occurrence of the additional symbols, in the manner of poker or the like. No numerical value is considered for the card hands of the game, as in the present invention.

U.S. Pat. No. 5,154,429 issued to Richard A. LeVasseur on Oct. 13, 1992 discloses a Method Of Playing Multiple Action Blackjack in which the players are each dealt a single hand, with the dealer being dealt two consecutive hands. Play of the first and second dealer hands and the player hands is conventional, with each player allowed to place a wager on the outcome of each of the dealer hands. Each player uses the same hand against each dealer hand. Conventional blackjack or twenty one rules are otherwise used.

U.S. Pat. No. 5,288,081 issued to John G. Breeding on Feb. 22, 1994 discloses a Method Of Playing A Wagering Game using conventional poker hand values, but allowing the players to divide their bets into three components. The dealer turns over one card at a time from his/her hand, whereupon players are allowed to withdraw a portion of their bets if they wish, prior to the dealer turning up the next card. No comparisons of the numerical values of the hands is made, in accordance with the rules of poker.

U.S. Pat. No. 5,314,193 issued to Emilio Ferrer on May 24, 1994 discloses a Method Of Playing A Wagering Casino Type (sic) in which numbered cards are valued according to their numbers, and face or court cards each have a value of one half. The game is similar to seven and one half insofar as card values are concerned, but the object is to achieve as high a value as possible so long as one half point is included in the value of the hand. The maximum value of a hand is ten and one half, with values exceeding that having the tens digit dropped. No provision for flush hands in addition to or along with other scoring, is provided.

Finally, PCT Patent No. WO 92/16269 to BET Technology, Inc. and published on Oct. 1, 1992 discloses a Wagering Game similar to the Boylan et al. game discussed further above; priority for this PCT Patent is based upon the Boylan et al. patent discussed above. Accordingly, no resemblance is seen to the present game.

None of the above noted patents, taken either singly or in combination, are seen to disclose the specific arrangement of concepts disclosed by the present invention.

SUMMARY OF THE INVENTION

By the present invention, an improved card game is disclosed.

Accordingly, one of the objects of the present invention is to provide an improved card game which uses at least one deck of standard playing cards, with numbered cards from ace through nine being valued at face value and tens and court cards having no value.

Another of the objects of the present invention is to provide an improved card game which object is to reach a total point count of nine, using the above card values.

Yet another of the objects of the present invention is to provide an improved card game which also provides payoffs for three of a kind and flush hands, in addition to hands closest to a count of nine.

Still another of the objects of the present invention is to provide an improved card game which three of a kind and flush payoffs are also based upon the acquisition of a numerically winning hand.

A further object of the present invention is to provide an improved card game in which only the dealer is restricted to rigid, inflexible rules regarding the drawing of an additional card or standing pat on the initial deal.

An additional object of the present invention is to provide an improved card game which in the simplest of circumstances provides for the winning of a hand based upon numerical superiority, but in other circumstances requires achieving a specific numerical count in the hand in order to win.

Another object of the present invention is to provide an improved card game in which ties or standoffs are provided for.

Yet another object of the present invention is to provide an improved card game which is suitable for casino play, and which provides for simultaneous wagers upon the occurrence of flush hands as well as the numerical outcome of the hand.

A final object of the present invention is to provide an improved card game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
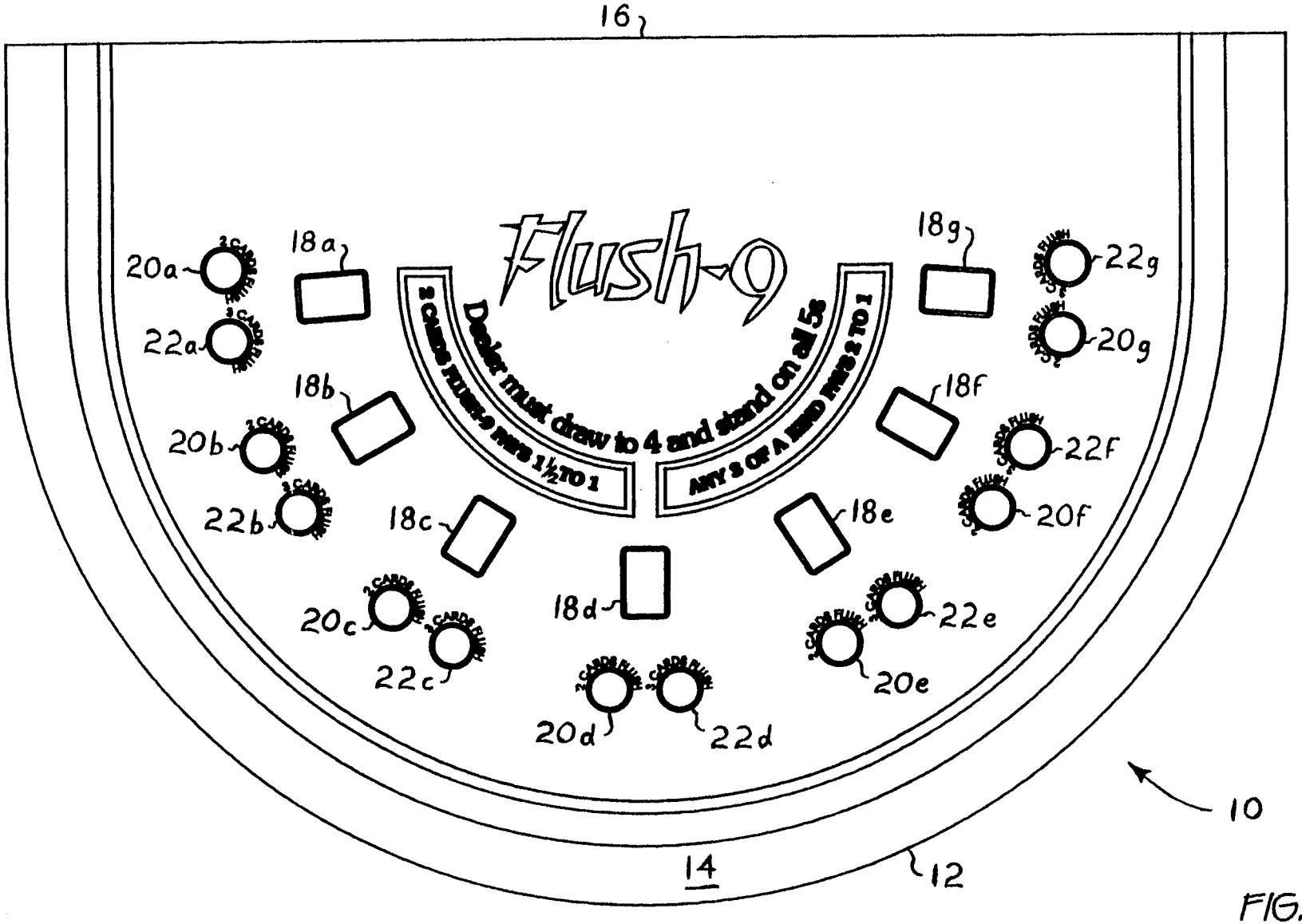
FIG. 1 is plan view of the game table provided for the present game, showing its various features.

Referring now to the drawings, the present invention will be seen to relate to a card game involving the occurrence of flush and/or three of a kind hands, while simultaneously attempting to acquire a total of nine points based upon the values assigned to the cards. The present game is played using one or more standard decks of playing cards, with each deck comprising fifty two cards of four suits. Each suit contains thirteen cards, from ace (or one) through king. The ace through nine of each suit are counted at face value for purposes of determining the counting or point value of each hand, with the ten, jack, queen, and king of each suit having zero counting value in the present game.

FIG. 1 discloses a plan view of a gaming table layout 10 providing for the play of the present card Game. The table 10 includes a semicircular or curved player periphery 12 with a cushion 14 therearound, and an opposite dealer periphery 16. The arrangement permits the dealer to face each of the plural players of the game, and for each of the players in turn to face the dealer.

The dealer initially deals two cards face down to each player, and two cards to the dealer, with the first dealer card being dealt face up. Players are permitted to look at their cards and place their bets in their respective betting boxes 18*a* through 18*g*. (It will be understood that the present table 10 may include positions for more or fewer players, as desired.) Players are also permitted to place additional wagers on the chance that they will have a two card or three card flush, respectively by placing an additional wager(s) in the two card flush betting circles 20*a* through 20*g* and/or three card flush betting circles 22*a* through 22*g*.

Figure 2A:
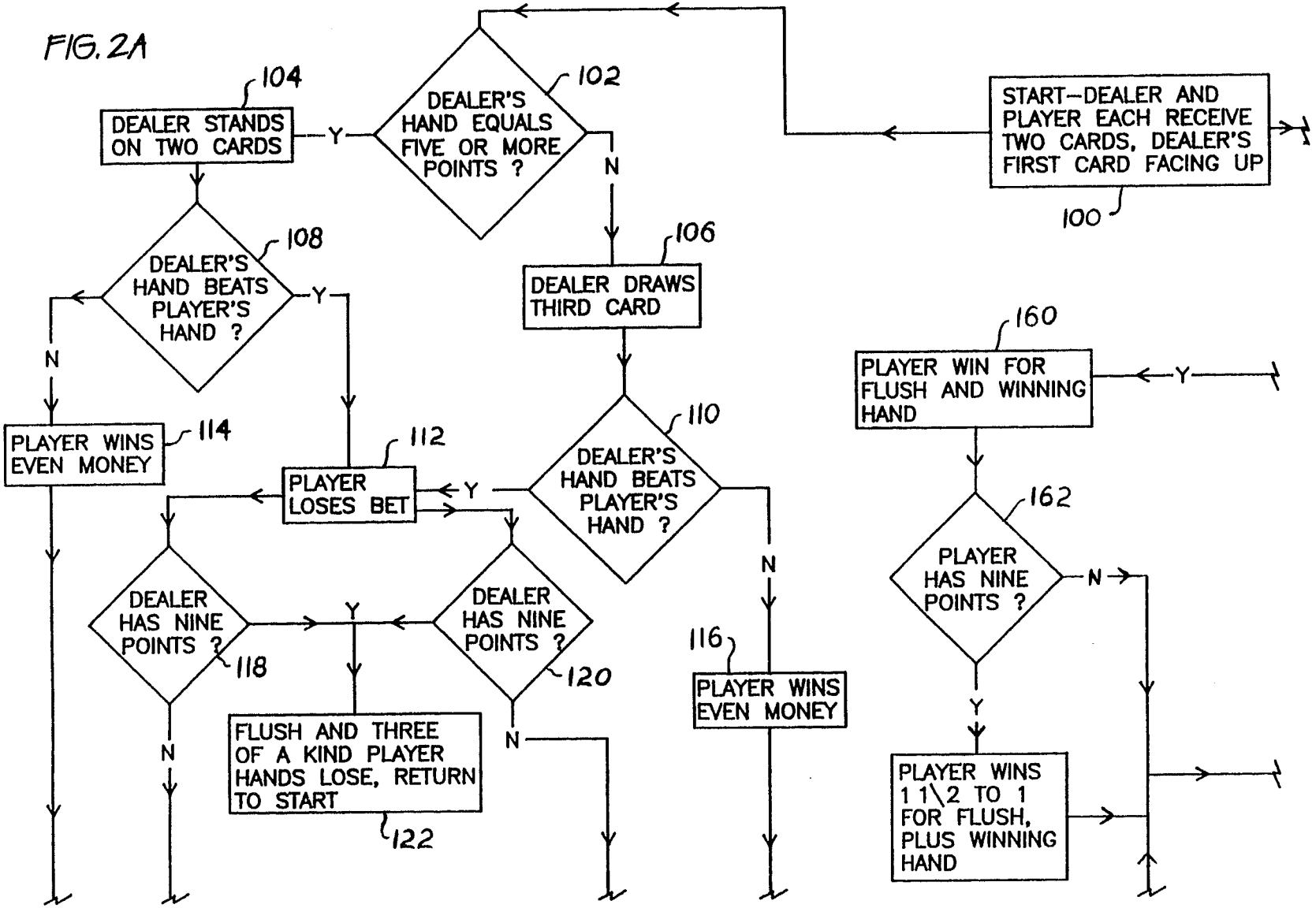
FIG. 2A is a first sheet of a block diagram or flow chart showing the steps involved in the play of the present card game.
Figure 2B:
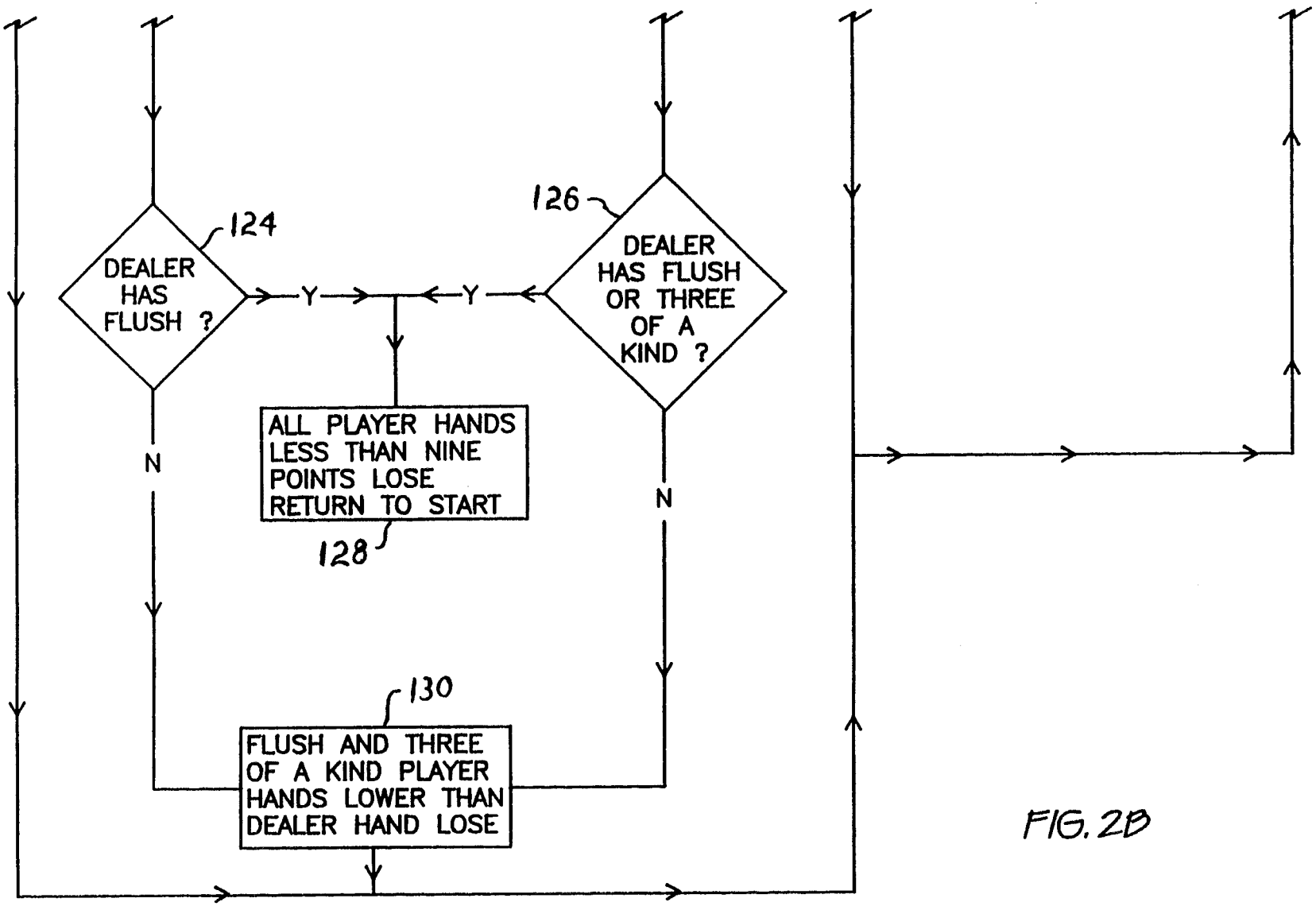
FIG. 2B is a second sheet of a block diagram or flow chart showing the steps involved in the play of the present card game.
Figure 2C:
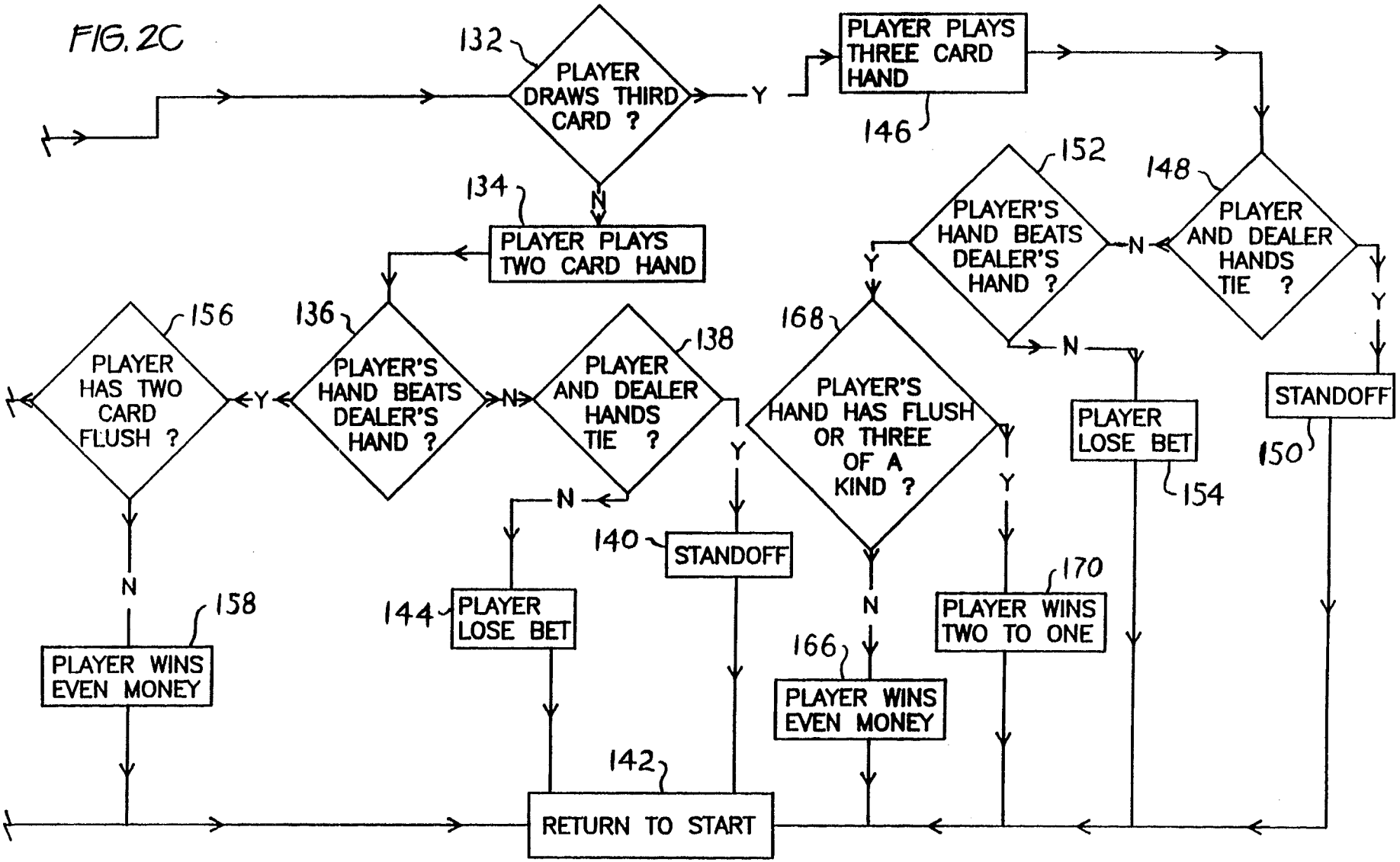
FIG. 2C is a third sheet of a block diagram or flow chart showing the steps involved in the play of the present card game.

FIGS. 2A through 2C disclose a flow chart showing, the method of play of the present game. The chart of FIGS. 2A through 2C will be referred to throughout the balance of the specification. A starting position 100 is shown in the upper right portion of FIG. 2A, describing the dealing of the cards as above in the description of the table layout 10. Players are permitted to draw a third card at any time they wish, but the dealer is restricted to rigid and inflexible rules governing the drawing of a third card. The dealer must "stand," or continue to hold the original two cards dealt, if the dealer's point count for those two cards (one face up and one face down) are equal to five points or more, as indicated in the second step 102 and third step 104 of FIG. 2A. On the other hand, the dealer must draw a third card if the dealer's hand has a count of four or fewer points, as indicated by the step 106 of FIG. 2A. While most of the outcome will be similar whether the dealer (or any of the players) have two or three cards, obviously a player must have three cards in order to have three of a kind, which possibilities are discussed further below.

As an example of the above, let us assume that the dealer receives an eight for his/her first or "face up" card, and after dealing the second cards to all players and dealer, and third cards to any players requesting such, deals a third card to the dealer's hand. Players will then know that the dealer's total point count for the first two cards is less than five (the tens digit is dropped for any total over ten points), thus indicating that the dealer received a second card between two and six inclusive. For example, if the dealer had received a four for a second card, the total of four and eight would be twelve, whereupon the ten is dropped for a count of two, requiring the drawing of a third card.

As a further example, let us assume that the dealer received a face card (jack, queen, king) for his/her second card. As such face cards have no value in determining the count of the hand, only the initial face up card (e.g., eight) would count. In such a situation, with the dealer hand having a count of five or more points, the dealer must "stand," and not draw a third card. The point count of the player hands is determined in exactly the same manner, but the players are not restricted to certain point totals in order to determine whether to draw a third card; a player may draw a third card after the dealing of the first two cards, no matter what the point count of the player's hand may be.

At this point, the dealer and player hands are compared, as shown in the steps 108 (for a two card dealer hand) and 110 (for a three card dealer hand) of FIG. 2A. If the dealer's hand beats the player's hand(s), as indicated respectively in the steps 108 and 110 of FIG. 2A, then the player(s) having the losing hand(s) lose their bet(s), as shown in step 112 of FIG. 2A. On the other hand, if the player's hand(s) beats the dealers hand, then those players with winning hands win their bet(s) with an even money payoff, as indicated by the steps 114 and 116 respectively for two and three card dealer hands.

Each player hand is compared separately to the single dealer hand, and the player hands have no relationship or dependence upon one another. In the event of a tie (or "standoff") with the dealer hand, the bet is canceled, with no winner determined. (This step is shown in other portions of the chart, but is not included in FIG. 2A for clarity.) Tie bets placed may be carried over to the next hand, if desired. As noted above, these bets pay off at even money, i.e., for every dollar bet, the payoff is one dollar.

As indicated further above, the object of the game is to achieve a total point count of nine with the two (or three) cards of the hand. A hand of nine cannot lose; the worst outcome for such a hand (either dealer or player) is a "standoff," in the event that the other hand is also worth nine points. In the event that a player achieves a nine point winning hand with two cards, which in addition is flush (i.e., both cards are of the same suit), the payoff to the player is one and one half to one (e.g., a $10 bet pays off at $15).

The present game provides further opportunities for players, in the form of the chance occurrence of three of a kind (i.e., three aces, three kings, etc.). Obviously, a three of a kind can only occur in a hand having three cards, i.e., one in which the dealer's initial count was four or less for his/her first two cards, or in which the player chose to accept a third card. The possibility of a three of a kind occurring in such hands may be seen as somewhat of a "wild card" opportunity, wherein a three of a kind hand is an automatic even money winning hand. The only times such a three of a kind hand would lose, is when the opposite hand contains only two cards totaling exactly nine points. As an example of the above, let us assume a player received a pair of cards of identical rank (e.g., fours, aces, jacks, etc.) for his/her first two cards, and chose to take a third card which turned out to be identical to the first two cards of the pair. This hand would automatically win even money, unless the dealer's hand was a two card hand totaling nine points—in which case the dealer's hand would win, as indicated in the steps 118 through 122 of FIG. 2A. The opposite is also true, in which the dealer has a three of a kind and the player has two cards totaling nine points.

The above described three of a kind occurrences do not require any active betting on the part of the player(s) in order to win or lose according to the above described rules. However, the present game provides for further active betting on the part of the players over and above the outcome of a numerically superior player hand, by means of betting on the occurrence of a flush hand on the part of the player. A player is allowed to bet upon such occurrence, by placing a wager on either the two card flush areas 20*a* through 20*g*, or the three card flush areas 22*a* through 22*g*, of table 10.

Continuing the discussion of the play of the present game from the viewpoint of the dealer, it will be seen in FIG. 2B that the occurrence of a two card dealer hand flush (per step 124 of FIG. 2B) or a three card dealer hand flush or three of a kind) per step 126 of FIG. 2B) will beat any player hand(s) totaling less than nine points. Thus, a player bet upon a player hand two or three card flush (the player is not allowed to bet upon the outcome of events in the dealer hand) would lose, assuming that the dealer hand was either flush or three of a kind, as indicated by the step 128 of FIG. 2B. The only winning bet for such a player would be for the numerical superiority of the player's hand, if the player's hand contained exactly nine points.

However, if the dealer hand does not contain a flush or three of a kind, then the player hand need only be higher than the dealer hand in order to win, e.g., a player hand of six would beat a dealer hand of five or less. This is indicated in step 130 of FIG. 2B, wherein it is stated inversely that player hands (including those containing a flush or three of a kind) which are lower than the dealer hand, will lose (e.g., dealer hand of seven, player hand of six or fewer points).

The discussion of the present game thus far has been primarily from the viewpoint of the dealer. The remainder of the flow chart, disclosed in FIG. 2C, is primarily from the viewpoint of a player of the present game, and will be discussed from that viewpoint in the following paragraphs. As indicated in the step 132 of FIG. 2C, a player has the option of drawing a third card after receiving his/her first two cards, without restriction as to the count of the first two cards. This is unlike the dealer hand, in which the dealer is restricted according to the point count of the first two cards.

Assuming the player decides to "stand" and play with the original two cards dealt, as indicated in the step 134 of FIG. 2C, the player's two card hand is then compared to the dealer's two (or three) card hand, as indicated in the step 136 of FIG. 2C. If the two hands tie, as indicated in the step 138 of FIG. 2C, then a "standoff" occurs, as in step 140. Any bets are held over to the next hand, or allowed to "ride," and another hand is dealt, as indicated by the "Return to Start" step 142 of FIG. 2C. Alternatively, step 138 provides for a non-tie between the two hands, which in consideration of the non-winning case following from step 136, results in a loss for the player hand, as indicated by step 144 of FIG. 2C. Again, the game returns to a starting step in which new hands are dealt to the players and dealer.

In the event a player draws a third card and plays a three card hand, as in step 146, an analogous chain of steps occurs, wherein the player's hand may tie the dealer's hand (step 148), which may result in a standoff (step 150) in the event of a tie, or either the player's or dealer's hand winning, as in step 152. If the dealer's hand wins, the player loses the bet, as in step 154.

As noted above a player has the option of betting upon the occurrence of a two or three card flush in the player's hand. In the case of a two card player hand (step 134, FIG. 2C) where the player's hand beats the dealer's hand (step 136, FIG. 2C), the player will at worst win even money, even if the player does not have a flush hand, as indicated in step 158 of FIG. 2C. However, if the player also has a two card flush, as provided for in the step 156 of FIG. 2C, then the player will win even money for his/her winning hand, plus even money for the flush hand, as indicated in the step 160 (carried over to FIG. 2A). If the player also has a hand of exactly nine points (step 162 of FIG. 2A), in addition to the above, the player payoff is at one and one half to one, as indicated by the step 164 of FIG. 2A. Thus a player with a two card flush hand of exactly nine points, will win even money for the winning hand, another even money bet for any wager on the occurrence of a flush hand, and an additional fifty percent of the flush hand bet.

Returning to FIG. 2C, additional possibilities of a three card flush or three of a kind occur when a player has a three card hand, as provided for in step 146. The possibilities of a player hand losing or tying the dealer's hand have been discussed above, as shown in steps 148 and 152. However, in the event that the player's hand beats the dealer's hand, as provided for in one of the possibilities of step 152, the player will win at least even money on any bet placed, as provided for in the step 166 of FIG. 2C. This will be true even when the player hand is not flush and does not have three of a kind, as in one of the alternatives of the step 168 of FIG. 2C.

The other possibility of step 168 is that the player will have either a three card flush or three of a kind. When such occurs the player will win any bet placed upon the chance of a three card flush occurring, at two to one, as indicated by the step 170 of FIG. 2C. As a three card flush by definition also includes two cards of the same suit, the two to one payoff also provides for a two card flush payoff, hence the two to one payoff including both two and three card flushes in the same hand. As noted above, no provision is made for active betting on the occurrence of three of a kind in either the dealer hand or any of the player's hands, but the present game nevertheless provides an automatic payoff of two to one when such occurs in a player hand and the player hand beats the dealer hand, as described further above. Hence, the steps 168 and 170 also include provision for a two to one payoff when the player hand includes three of a kind, as described further above from the viewpoint of the dealer in FIGS. 2A and 2B.

In summary, the above described game will be seen to provide numerous winning possibilities for a player, from merely drawing a numerically superior hand, to betting on and obtaining two and three card flushes, to the possibility of an automatic win for a three of a kind hand. The experienced player may enjoy the relatively fast pace of determining the numerically superior dealer or player hand(s), while a less experienced player may enjoy wagering on the outcome of easily seen occurrences, such as flush hands. The fact that such flush hands are also tied in with numerically superior hands in order to win, provides an additional element of interest to the present game. Moreover, players cannot exceed the predetermined total of nine points, as only the ones digit is used when counting the point value of a hand. This adds further interest to the game, as it is impossible for a player to "bust" by exceeding the predetermined total, and accordingly be eliminated from play, as in many other games. In the present game a player always has a chance to win, up to the actual comparison of player and dealer hands, which adds interest to the game for the players involved. The additional freedom the player enjoys in being able to draw a third card at any time during the deal, also provides some advantage for the experienced player over the dealer, as the dealer is restricted by rigid, inflexible rules governing the drawing of a third card for play of the dealer hand. The result of the above is a game which is fast paced for the experienced player, with many nuances and possibilities, and which still provides for ease of play for the less experienced player. The game holds the interest of all players, due to the impossibility of "busting" a hand, and the astute player may gain some advantage due to his/her unlimited third card option.

It is to be understood that the present invention is not limited to the sole embodiment described above, but encompasses any and all embodiments within the scope of the following claims.

I claim:

1. A method of playing a card game, comprising the following steps:

(a) Providing at least one deck of playing cards comprising four suits totaling fifty two cards, with each suit including thirteen cards ranking from ace through king;

(b) assigning a value to each of the cards, with the ace through nine of each suit respectively being assigned values of one through nine points, and the ten through king of each suit each being assigned a value of zero;

(c) forming dealer and player hands by dealing two of the cards randomly to each player and to the dealer of the game, with the first card to the dealer being dealt face up and all others face down;

(d) placing wagers on the outcome of play of the card game;

(e) adding the values of the cards in each of the hands and dropping the tens digit to provide a number between zero and nine points, and determining a winning hand by determining which hand is closest to a total of nine points;

(f) determining whether any of the hands are formed entirely of cards of the same suit to form a flush hand, and;

(g) providing a payoff for any wagers placed upon winning and flush hands.

2. The method of playing a card game according to claim 1, including the step of:

(a) canceling all wagers when dealer and player hands have equal values.

3. The method of playing a card game according to claim 1, including the step of:

(a) losing any player flush hand wager when the dealer hand totals nine points and is higher than the player hand.

4. The method of playing a card game according to claim 1, including the steps of:

(a) requiring the dealer to stand with a two card total of five points or more points and to draw a third card with a two card total of four or fewer points, and;

(b) allowing each player to draw a third card as desired.

5. The method of playing a card game according to claim 4, including the steps of:

(a) determining whether any of the hands are formed entirely of cards of the same suit to form a flush hand, and;

(b) determining whether any three card hands are formed of three cards of equal rank from three different suits to form three of a kind.

6. The method of playing a card game according to claim 5, including the steps of:

(a) providing a payoff of one and one half times the amount, wagered for flush hands having a value of nine points, and;

(b) providing a payoff of twice the amount bet for hands formed of three of a kind.

7. The method of playing a card game according to claim 6, including the steps of:

(a) losing any player flush hand wager when the dealer hand totals nine points and is higher than the player hand, and;

(b) losing any player three of a kind wager when the dealer hand totals nine points and is higher than the player hand.

8. The method of playing a card game according to claim 5, including the step of:

(a) losing any player flush hand wager when the dealer hand is flush and totals nine points, and is numerically higher than the player hand.

9. The method of playing a card game according to claim 5, including the step of:

(a) losing any player wager when the dealer hand includes three of a kind and totals nine points, and is numerically higher than the player hand.

* * * * *